US006782789B2

(12) United States Patent
McNulty, Jr.

(10) Patent No.: US 6,782,789 B2
(45) Date of Patent: Aug. 31, 2004

(54) ELECTRIC DISCHARGE WEAPON FOR USE AS FOREND GRIP OF RIFLES

(76) Inventor: James F. McNulty, Jr., 1290 Third St., Calimesa, CA (US) 92320

( * ) Notice: Subject to any disclaimer, the term of this patent is extended or adjusted under 35 U.S.C. 154(b) by 0 days.

(21) Appl. No.: 10/237,275

(22) Filed: Sep. 9, 2002

(65) Prior Publication Data

US 2004/0045207 A1 Mar. 11, 2004

(51) Int. Cl.[7] ..... B64D 1/04; F42B 8/00
(52) U.S. Cl. ..... 89/1.11; 42/85
(58) Field of Search ..... 42/40, 1.08, 70.11, 42/146, 85; 89/1.11, 1.1; 22/117

(56) References Cited

U.S. PATENT DOCUMENTS 689,547 A * 12/1901 James ..... 42/146
1,045,800 A * 11/1912 Lewis
1,338,239 A * 4/1920 Matys
1,535,459 A * 4/1925 Fredrickson ..... 42/146
2,093,514 A * 9/1937 Cornett et al.
2,977,580 A * 3/1961 Sprecher
3,374,708 A * 3/1968 Wall ..... 89/1.11
3,803,463 A * 4/1974 Cover
4,253,132 A * 2/1981 Cover ..... 42/1.08
4,688,140 A * 8/1987 Hammes
4,777,754 A * 10/1988 Reynolds, Jr.
4,982,645 A * 1/1991 Abboud ..... 89/1.11
5,220,115 A * 6/1993 Wales et al.
5,243,894 A * 9/1993 Minovitch ..... 89/1.11
5,473,501 A * 12/1995 Claypool ..... 89/1.11
5,625,525 A * 4/1997 Coakley et al.
5,654,867 A * 8/1997 Murray
5,671,559 A * 9/1997 Ludaesher et al. ..... 42/1.08
5,787,628 A * 8/1998 Teetzel ..... 42/1.08
5,822,905 A * 10/1998 Teetzel
5,831,199 A * 11/1998 McNulty et al. ..... 89/1.11
5,983,548 A * 11/1999 Ludaescher ..... 42/1.08
6,022,120 A * 2/2000 Chang
6,053,088 A * 4/2000 McNulty, Jr. ..... 89/1.11
6,256,916 B1 * 7/2001 McNulty ..... 89/1.11
6,360,645 B1 * 3/2002 McNulty, et al. ..... 89/1.11
6,636,412 B2 * 10/2003 Smith ..... 89/1.11

* cited by examiner

*Primary Examiner*—Michael J. Carone
*Assistant Examiner*—L. Semunegus
(74) *Attorney, Agent, or Firm*—Leonard Tachner

(57) ABSTRACT

A TASER and a vertical grip are combined to be attached to the stud post under the forend or the barrel of a conventional long arm. A TASER may also be combined with the forend or barrel of a conventional long arm itself. Stud posts come standard on certain long arms like the M-16 rifle. Stud posts can be installed on single shot and pump action shotgun forends as well. The TASER power supply can serve as a power source for a strobe lamp, which may be sighted by rescuers either visually or with infrared night viewing or other special viewing equipment for miles. The optical signal could be produced in the infrared, visible light and ultraviolet light regions of the electromagnetic spectrum. The signal lamp is inserted into a TASER's firing chamber in lieu of an ammunition cartridge.

5 Claims, 5 Drawing Sheets

ELECTRIC DISCHARGE WEAPON FOR USE AS FOREND GRIP OF RIFLES

BACKGROUND OF THE INVENTION

1. Field of the Invention

The present invention relates generally to apparatus for improving the versatility of rifles and more specifically to a forend grip configured to provide an electrical discharge weapon (i.e., TASER) which can receive either a cartridge having wire-tethered darts or a strobe light for signaling friends or for blinding enemies.

2. Background Art

TASERs are weapons that can connect a disabling shock from a remote power supply to a violent assailant. The TASER launches a pair of electrically opposed darts with trailing wires from its power supply to an assailant to connect the assailant to the supply. TASERs have a lower lethality than conventional firearms. U.S. Pat. No. 3,803,463 was issued to Cover for the TASER in 1974. Since that time, the TASER has seen application in the United States as a law enforcement tool and the U.S. military has interest in the TASER for policing actions. TASERs are regularly used by peace officers to humanely capture suicidal or otherwise violent, even armed suspects, who are themselves victims of intoxicants, drugs and/or emotional disturbance, without serious injury to suspects, officers or bystanders.

The main problem with the TASER, which has several tactical limitations, is that it is a discrete weapon. To be readily accessible for potential application, it must be separately holstered on the already quite limited space on a peace officer's utility belt or otherwise on the already quite limited space available for additional ordnance and weight on the person of the peace officer or soldier. Sufficient unused space to holster a TASER may not be available. The TASER is necessarily a relatively large side arm. The space is needed to isolate the weapon's arcing high voltage circuitry. A typical TASER is described in U.S. Pat. No. 5,654,867 to Murray. At least partially for the above reasons, the TASER has only been deployed on a limited basis by law enforcement, and the TASER has not seen use in military policing actions. Deployment of conventional weapons could be reduced and countless lives saved and injuries avoided, if the TASER were more convenient for peace officers to bear and, thereby, more available for their use.

Combining the TASER with a conventional firearm can overcome the TASER's heretofore described storage and transport disadvantages. Several patentees, including the inventor herein, have previously attempted to combine the TASER with conventional firearms. U.S. Pat. No. 5,698,815 issued to Ragner. The Ragner apparatus has proved impractical and has never been commercially manufactured. U.S. Pat. No. 5,831,199 issued to McNulty. With the current state of the art, the ammunition cartridge descried therein can only be manufactured as a minimum 38 to 40 mm diameter and 8" length cartridge and is, therefore, only suitable for discharge through the barrels of certain breech loading tear gas guns. Manufactured as the discharger cup described in the specification, the apparatus has no transport or storage advantages over discrete TASERs.

SUMMARY OF THE INVENTION

In the present invention a TASER and a vertical grip are combined to be attached to the stud post under the forend or the barrel of a conventional long arm. A TASER may also be combined with the forend or barrel of a conventional long arm itself. Stud posts come standard on certain long arms like the M-16 rifle. Stud posts can be installed on single shot and pump action shotgun forends as well. Installation kits are sold for this purpose. The TASER and vertical grip combination eliminates the TASER's earlier described storage and transport disadvantages. It also eliminates many of the other of the TASER's problems described in U.S. Pat. No. 5,831,199 to McNulty at lines 30 to 53 of Column 3 and lines 1 to 39 of Column 4. The TASER is less likely to be fired at an ineffectively close range because the firearm barrel extending beyond the TASER's launcher, serves as a stand off. Conventional firearms used for home protection need not be kept loaded, thereby, risking injury and death to innocent children and others, as the combined TASER can serve as the first line of home defense. If a TASER deployment should fail or if a confrontation should escalate, the peace officer or soldier would have the conventional firearm for immediate backup. Moreover, the TASER may alternately serve as a signaling device or rescue beacon for both combatants or sportsmen in need of rescue. The TASER power supply can serve as a power source for a strobe lamp, which may be sighted by rescuers either visually or with infrared night viewing or other special viewing equipment for miles. The optical signal could be produced in the infrared, visible light and ultraviolet light regions of the electromagnetic spectrum. Visible light occupies the region with wavelengths from approximately 400 nanometers to 700 nanometers. When produced outside of the visible light region of the spectrum the signal would be visible to rescuers with special viewing equipment while the signaler remained concealed to less technically sophisticated enemies. The signal lamp is inserted into a TASER's firing chamber in lieu of an ammunition cartridge. The TASER power supply's high voltage output might alternatively be switched from the TASER's firing chamber to the lamp. It would be undesirable to operate both the lamp and shock circuits simultaneously as this would likely give away the combatants position to his enemies. With either configuration, after the lamp or beacon is switched on, the frequency of the power output might be decreased to extend operation time. When detached from the rifle, the forend grip lantern might also serve as a roadside hazard marker or as a landing zone marker for emergency helicopters.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
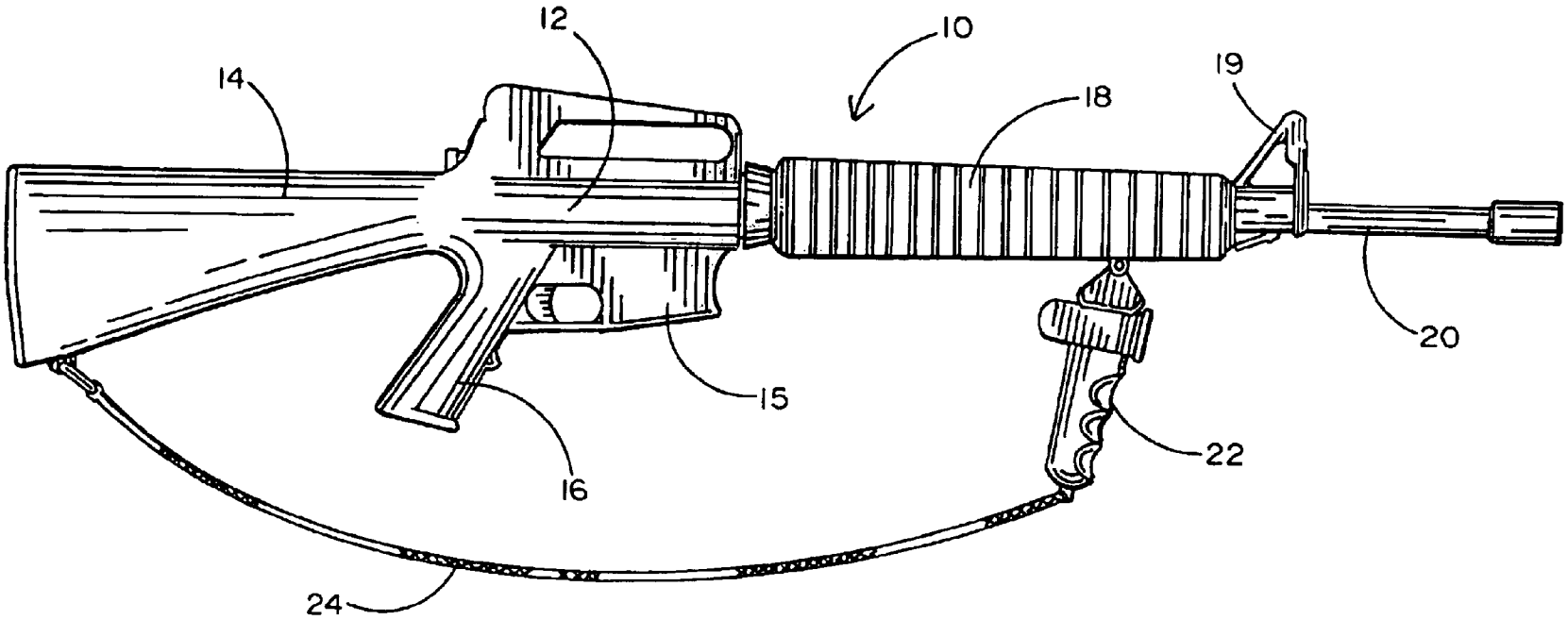
FIG. 1 is a side view of the invention shown installed on an M16 rifle.
Figure 2:
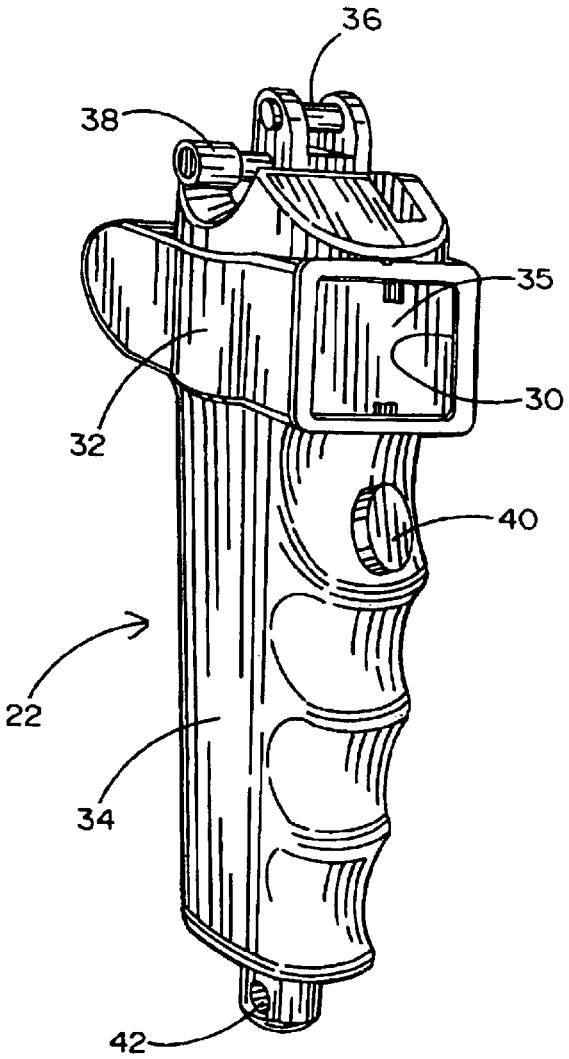
FIG. 2 is a three-dimensional view of a preferred embodiment of the invention.
Figure 3:
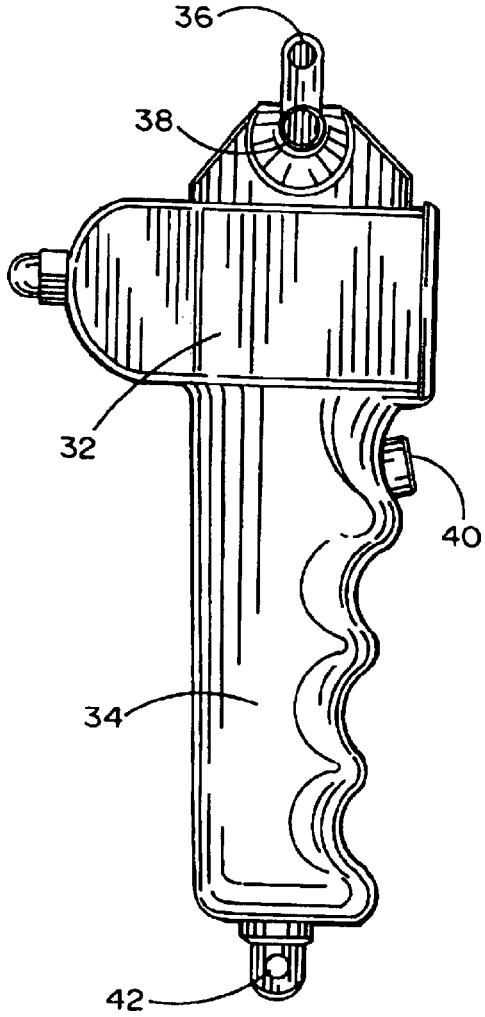
FIG. 3 is an enlarged side view of the embodiment of FIG. 2.

Referring to the accompanying drawings and particularly FIG. 1, it will be seen that a rifle 10 comprises a main body 12, a butt stock 14, a magazine receptacle 15, a pistol grip 16, a hand guard 18, a sight 19, a barrel 20, a forend grip 22 and a sling 24. The rifle depicted in FIG. 1 will be recognized as an M16A2 semiautomatic rifle which is currently the U.S. military standard. However, the present invention is not limited to deployment in an M16A2 rifle which is shown in FIG. 1 solely for purposes of illustrating the preferred configuration of the invention and its preferred method of attachment to a rifle. The invention herein resides in the forend grip 22 which uniquely provides an additional and highly advantageous function of backup weapon and/or strobe light. A prior art standard vertical forend grip, such as that grip sold under the trademark "Steadyhold" by Steadyhold Products of Cedar Rapids Iowa or the grip sold under the Trademark "Ergogrip" by Falcon Industries of Tijeras, N.M., is known in the firearms trade as an after-market accessory for rifles. It provides a comfortable additional holder for the non-trigger hand and adds a stabilizing function for better accuracy. It is typically a substantially monolithic, rubberized structure having means for attachment to the rifle along the barrel or hand guard.

The preferred embodiment of the present invention provides a vertical forend grip substitute which, for the most part, retains the external configuration of prior art grips. However, in the present invention the grip is configured to enclose a battery and electronics to house a TASER immobilization weapon having a chamber for receiving a TASER cartridge. The preferred embodiment of this unique, grip-configured TASER apparatus is seen best in FIGS. 2–5.

Grip 22 will be seen as comprising a chamber 30 in a housing 32 integrally constructed as a part of the grip body 34. The latter is hollow to provide an interior for receiving a battery and electronics (not shown) for TASER weapon operation. Such electronics are well known in the TASER art and need not be described herein in any detail. Suffice it say that such electronics are substantially the same as those described in U.S. Pat. Nos. 3,803,463 and 4,253,132 to Cover, the content of which is hereby incorporated herein by reference as if fully set forth herein. Chamber 30 receives a standard two-wire tethered dart cartridge 35 which may be selectively activated by a trigger switch 40. Grip/TASER 22 is attached to the rifle using a grip latch 36 and a latch lock 38, both of which are prior art elements of the existing forend grip and need not be described herein in greater detail. A sling hook 42 permits the sling 24 to be attached to the grip/TASER 22 in a conventional manner.

Figure 5:
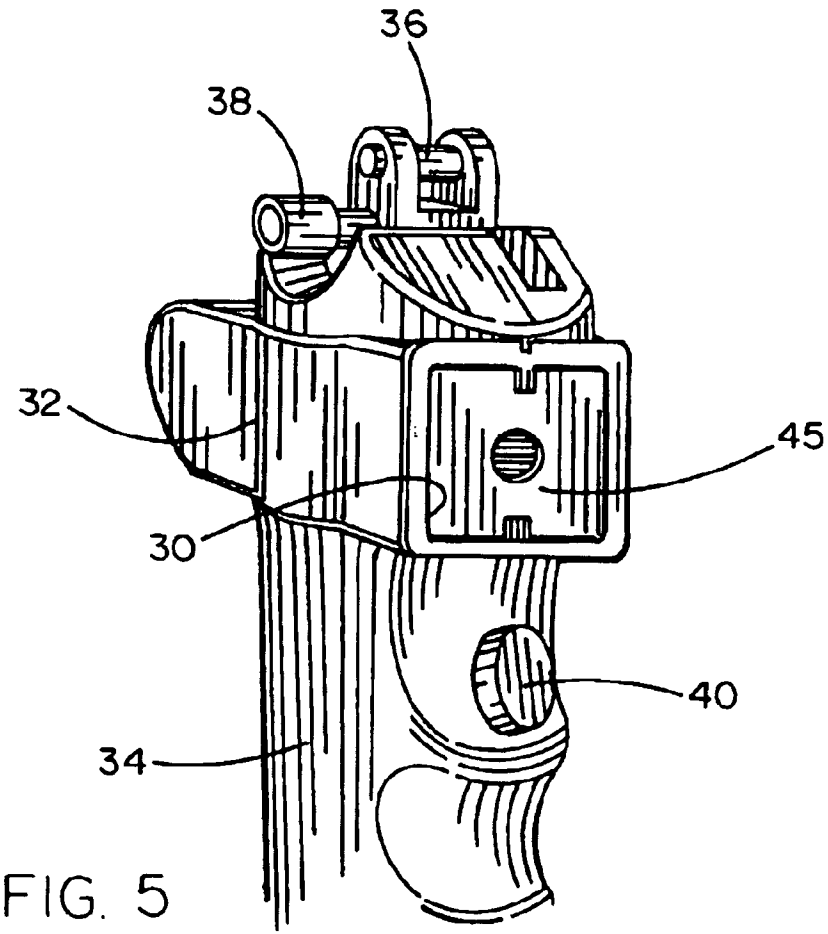
FIG. 5 is a partial three-dimensional view showing the preferred embodiment with a strobe light installed in the invention instead of a TASER cartridge.
Figure 4:
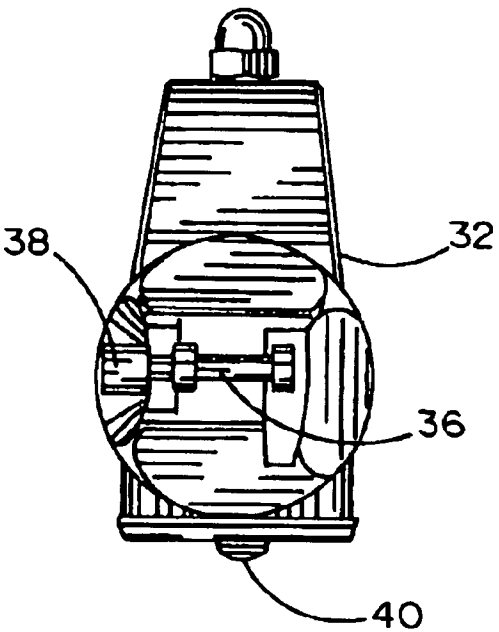
FIG. 4 is a top view of the embodiment of FIG. 2.
Figure 7:
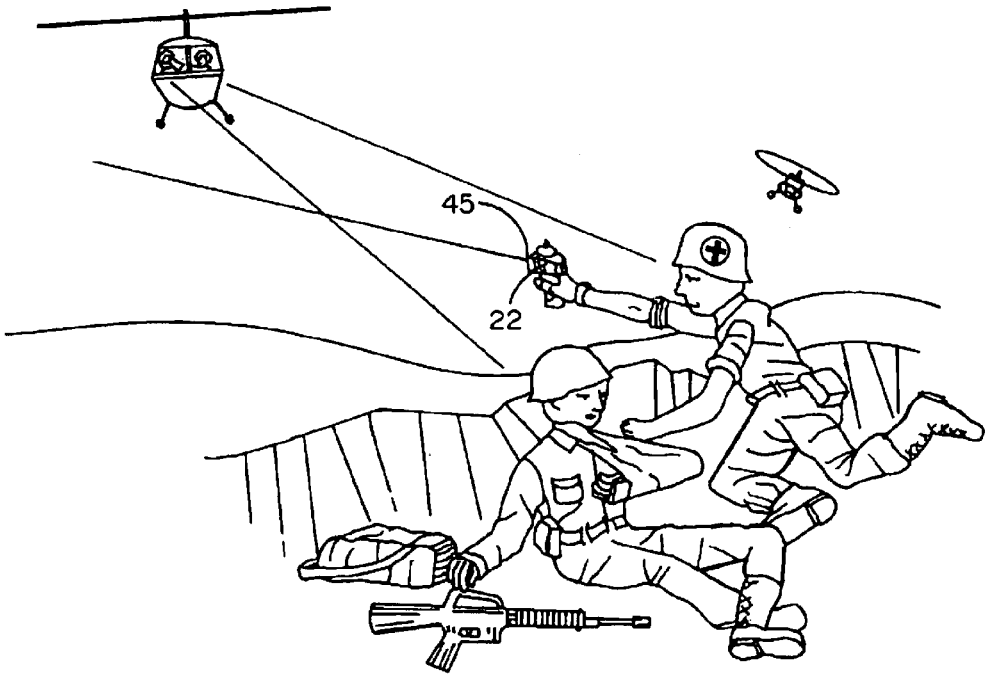
FIG. 7 illustrates a military scenario for use of the preferred embodiment with a strobe light or infrared light attachment.
Figure 8:
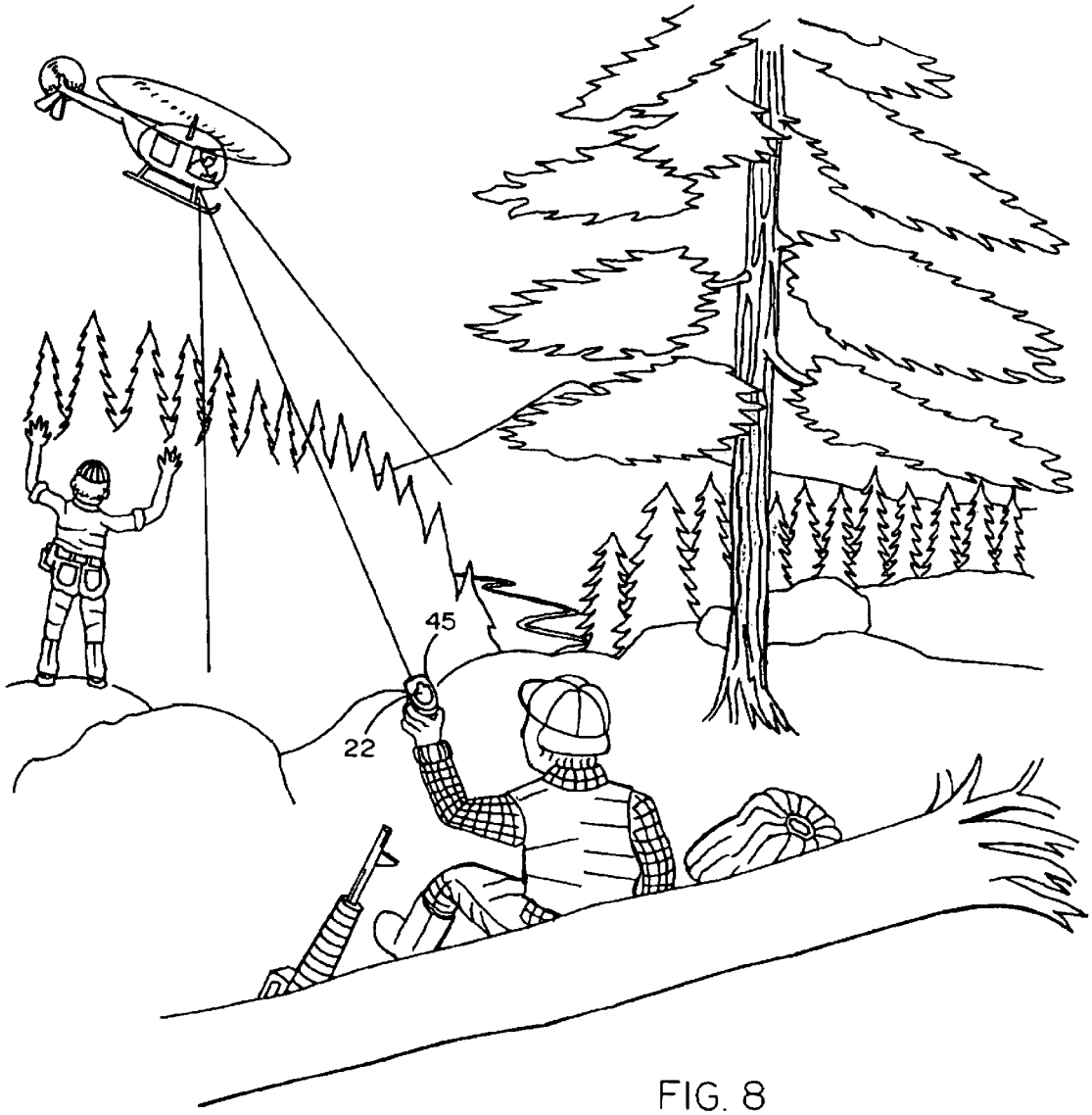
FIG. 8 illustrates a non-military scenario similar to that of FIG. 7.

Because the TASER cartridge is typically activated by a high voltage pulsed signal, cartridge 35 may be replaced by a strobe light 45 as shown in FIG. 5 which, in the preferred embodiment herein, is configured to operate at the same voltage and pulse rate to provide a visual signal as depicted in FIGS. 7 and 8. The light from strobe 45 may be either in the visual spectrum or in the infrared, the latter providing surreptitious optical signaling in a hostile environment. As shown in FIGS. 7 and 8, it may be desirable to remove grip/TASER 22 from the rifle to facilitate its use as an optical signaling device.

Figure 6:
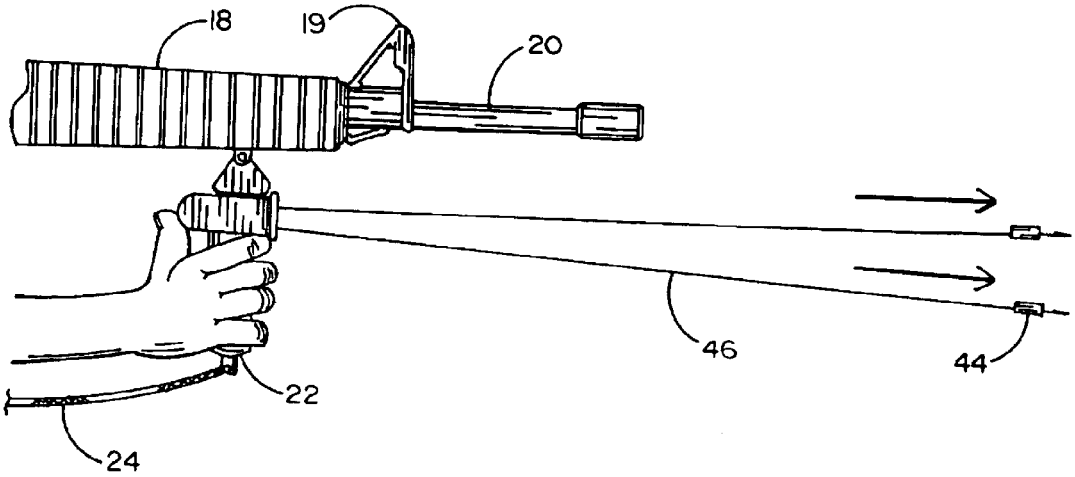
FIG. 6 is a partial side view of the invention shown on a rifle and being used to propel wire-tethered electrode darts toward a target.

Operation of the preferred embodiment of the invention is depicted in FIG. 6 which illustrates deployment of the grip/TASER 22 as an immobilization weapon. More specifically, the trigger switch 40 has been depressed thereby activating propellant in the cartridge 35 to propel darts 44 toward a target, each such dart being tethered by a thin wire 46 to the electronics in the grip/TASER body 34.

Having thus disclosed an illustrative example of the present invention, it will be understood that the disclosed embodiment is not limiting of the invention, but merely a description of its salient features in the presently contemplated best mode. By way of example, those having skill in the relevant art and having the benefit of applicant's teaching herein, will now perceive various modifications and additions which may be beneficial. Other structures, means for attachment to a rifle and activation will almost certainly come to mind, particularly in conjunction with other rifles. Thus, the scope hereof is to be limited only by the appended claims and their equivalents.

I claim:

1. A combination comprising:

a shotgun having a barrel for firing a lethal projectile at a remote target; and an electrical discharge immobilization weapon for selectively propelling two wire-tethered darts toward a remote target;

the immobilization weapon being mounted to said shotgun below its barrel without interfering with operation of said shotgun to provide both lethal and non-lethal firing selection in a combined weapon.

2. The combination recited in claim 1 wherein said immobilization weapon is integrated into a forearm of said shotgun.

3. A combination comprising:

a rifle having a barrel for firing a lethal projectile at a remote target; and an electrical discharge immobilization weapon for selectively propelling two wire-tethered darts toward a remote target;

the immobilization weapon being mounted to said rifle below its barrel without interfering with operation of said rifle to provide both lethal and non-lethal firing selection in a combined weapon.

4. The combination recited in claim 1 wherein said immobilization weapon is integrated into a forend grip of said rifle.

5. The combination recited in claim 1 wherein said immobilization weapon is attached to a rail of said rifle.

* * * * *

UNITED STATES PATENT AND TRADEMARK OFFICE

CERTIFICATE OF CORRECTION

PATENT NO. : 6,782,789 B2
APPLICATION NO. : 10/237275
DATED : August 31, 2004
INVENTOR(S) : James F. McNulty, Jr.

It is certified that error appears in the above-identified patent and that said Letters Patent is hereby corrected as shown below:

| | |
|---|---|
| Column 4, line 51, Claim 4 | Delete "1",<br>Insert --3-- |
| Column 4, line 54, Claim 5 | Delete "1",<br>Insert --3-- |

Signed and Sealed this

Twenty-third Day of September, 2008

JON W. DUDAS
*Director of the United States Patent and Trademark Office*

US006782789C1

(12) INTER PARTES REEXAMINATION CERTIFICATE (0120th)

United States Patent

McNulty, Jr.

(10) Number: US 6,782,789 C1

(45) Certificate Issued: Dec. 1, 2009

(54) ELECTRIC DISCHARGE WEAPON FOR USE AS FOREND GRIP OF RIFLES

(75) Inventor: James F. McNulty, Jr., Calimesa, CA (US)

(73) Assignee: Defense Technology Corporation of America, Jacksonville, FL (US)

Reexamination Request:
No. 95/000,360, May 15, 2008

Reexamination Certificate for:

| | |
|---|---|
| Patent No.: | **6,782,789** |
| Issued: | **Aug. 31, 2004** |
| Appl. No.: | **10/237,275** |
| Filed: | **Sep. 9, 2002** |

Certificate of Correction issued Sep. 23, 2008.

(51) Int. Cl.
*B64D 1/04* (2006.01)
*F42B 8/00* (2006.01)

(52) U.S. Cl. ..... 89/1.11; 42/85

(58) Field of Classification Search ..... None
See application file for complete search history.

(56) References Cited

U.S. PATENT DOCUMENTS

| | | | |
|---|---|---|---|
| 1,278,027 | A | 9/1918 | Saunders |
| 4,253,132 | A | 2/1981 | Cover |
| 5,590,484 | A | 1/1997 | Mooney |
| 5,962,806 | A | 10/1999 | Coakley |
| 6,142,058 | A | 11/2000 | Mayville |
| 6,532,947 | B1 | 3/2003 | Rosa |
| 6,636,412 | B2 | 10/2003 | Smith |
| 6,752,137 | B2 | 6/2004 | Brunette |

FOREIGN PATENT DOCUMENTS

| | | |
|---|---|---|
| WO | WO97/40332 | 10/1997 |

OTHER PUBLICATIONS

Smith, Patrick W., "M26 Less–Lethal EMD Weapon and M26A Dual Less–Lethal/Lethal Integrated M16 Platform Weapon", Presented at NDIA Non–Lethal Defense IV, Mar. 20–23, 2000, 25 pages, www.dtic.mil/ndia/nld4/smith.pdf.

*Primary Examiner*—Jeffrey R. Jastrzab

(57) ABSTRACT

A TASER and a vertical grip are combined to be attached to the stud post under the forend or the barrel of a conventional long arm. A TASER may also be combined with the forend or barrel of a conventional long arm itself. Stud posts come standard on certain long arms like the M-16 rifle. Stud posts can be installed on single shot and pump action shotgun forends as well. The TASER power supply can serve as a power source for a strobe lamp, which may be sighted by rescuers either visually or with infrared night viewing or other special viewing equipment for miles. The optical signal could be produced in the infrared, visible light and ultraviolet light regions of the electromagnetic spectrum. The signal lamp is inserted into a TASER's firing chamber in lieu of an ammunition cartridge.

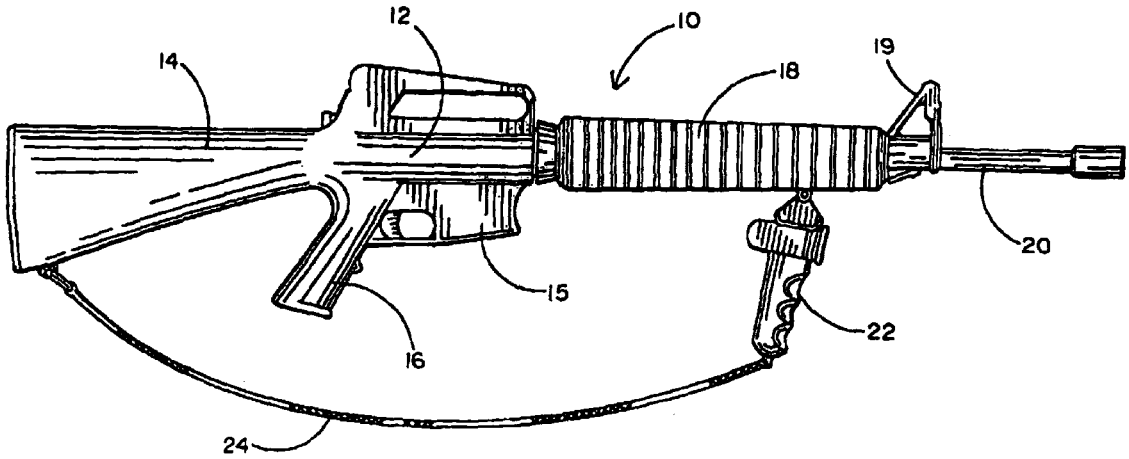

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1–5 are cancelled.

* * * * *